US005705766A

United States Patent [19]

Farace et al.

[11] Patent Number: 5,705,766

[45] Date of Patent: Jan. 6, 1998

[54] ELECTRONIC TURNS-COUNTING FUZE AND METHOD THEREFOR

[75] Inventors: Louis Pasqual Farace, Mesa; John Floyd Kaslow, Fountain Hills; Monty Wooson Bai, Scottsdale, all of Ariz.

[73] Assignee: Motorola, Inc., Schaumburg, Ill.

[21] Appl. No.: 550,054

[22] Filed: Oct. 30, 1995

[51] Int. Cl.[6] ..... F42C 15/00; F42C 9/14

[52] U.S. Cl. ..... 102/215; 102/202; 102/210; 102/211; 102/238; 102/266; 102/499

[58] Field of Search ..... 102/206, 210, 102/211, 215, 216, 231, 232, 237, 238, 266, 499, 500

[56] References Cited

U.S. PATENT DOCUMENTS

| | | | |
|---|---|---|---|
| 3,353,487 | 11/1967 | Perryman | 102/215 |
| 3,853,062 | 12/1974 | Cole | 102/70.2 R |
| 4,470,351 | 9/1984 | Farace | 102/215 |
| 5,325,784 | 7/1994 | Bai et al. | 102/293 |
| 5,343,795 | 9/1994 | Ziemba et al. | 102/215 |
| 5,497,704 | 3/1996 | Kurschner et al. | 102/215 |

OTHER PUBLICATIONS

An article entitled "Biomedical Low Impedance 0 to 6.0 PSI Differential Pressure Sensors" Motorola Semiconductor Technical Data.

*Primary Examiner*—Harold J. Tudor

*Attorney, Agent, or Firm*—Jeffrey Nehr; Bradley J. Botsch, Sr.

[57] ABSTRACT

A fuse (12) detonates a spin-stabilized projectile (10) after the fuse (12) experiences a preset number of turns. The preset number is communicated (64) to the fuse (12) prior to launch. A semiconductor piezoelectric strain gauge (26) senses stress and provides a signal which is responsive to centrifugal forces experienced by the sensor (26) as a result of projectile spin. A microcontroller (30) repetitively digitizes and translates the sensor signal to determine turn numbers, which the microcontroller (30) integrates to determine the total number of turns experienced by the fuse (12) since launch. When the accumulated turn number reaches (94) the preset number, the fuse (12) detonates the projectile (10). However, an arming duration (76) must have expired before the projectile (10) can detonate, and the projectile (10) can detonate at any time following the expiration of the arming duration when an impact is detected.

20 Claims, 3 Drawing Sheets

ELECTRONIC TURNS-COUNTING FUZE AND METHOD THEREFOR

FIELD OF THE INVENTION

The present invention relates generally to electronic fuzes which arm and/or detonate a projectile when the projectile experiences a preset number of turns.

BACKGROUND OF THE INVENTION

Fuzes insure that projectile munitions do not detonate prior to an instant when detonation is desired and initiate detonation at that desired instant. For many projectiles, detonation is desired when the projectile arrives at a precise location in space whether or not the projectile impacts a target at that location. Thus, fuzes which identify detonation locations have been devised.

Conventional fuzes measure elapsed time following set-back or the launch of a projectile. When a preset duration has transpired, the fuze may initiate the detonation sequence. The preset duration is calculated based upon the distance between the firing or launch point and the desired detonation location and upon the launch velocity of the projectile.

The time-measuring technique has many benefits. One of the major benefits is that electronic devices can be employed to measure time. Electronic devices are highly desirable in fuze applications because they can be miniaturized so that the fuze in which they are used can be employed on smaller caliber munitions. Moreover, they can be mass produced inexpensively, and they tend to be highly reliable.

However, the time-measuring technique suffers from an accuracy problem. Assuming that time may be measured with absolute accuracy, the resulting location determination nevertheless suffers in accuracy because launch velocity can vary several percent from situation to situation. Variations result from varying propellant quantity and quality, weather and altitude conditions, and wear or other tolerance factors in a gun from which the projectile is fired. In many instances, the launch velocity variation causes a detonation range error many times the lethal area of the projectile.

A turns-counting technique is theoretically more accurate at determining detonation location than time measurement. The turns-counting technique applies to spin-stabilized projectiles. Such devices are launched or fired from a gun barrel having rifling that has a characteristic twist factor, often expressed in turns per foot. This twist factor causes a fired projectile to spin at a certain number of turns, or fractions thereof, for each foot of travel irrespective of launch velocity. Because a fuze set to burst in a preset number of turns determines a traveled distance independent of launch velocity, it should more accurately identify a detonation location than a fuze set to burst after a preset duration.

Unfortunately, conventional turns-counting fuzes have enjoyed only a limited success. One reason may be the fact that conventional turns-counting fuzes have employed mechanical turn-detection devices which rely upon pendulums and the like. These mechanical devices are highly undesirable because they tend to be far too large for use in connection with smaller munitions. Moreover, they tend to be so expensive to manufacture and so unreliable that only in a few limited armament situations have they been useful. Furthermore, the mechanical turn-detection devices achieve only modest accuracy in counting turns, Consequently, equivalent results can often be achieved with time-measuring techniques that can measure elapsed time with great accuracy.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE DRAWINGS

Figure 1:
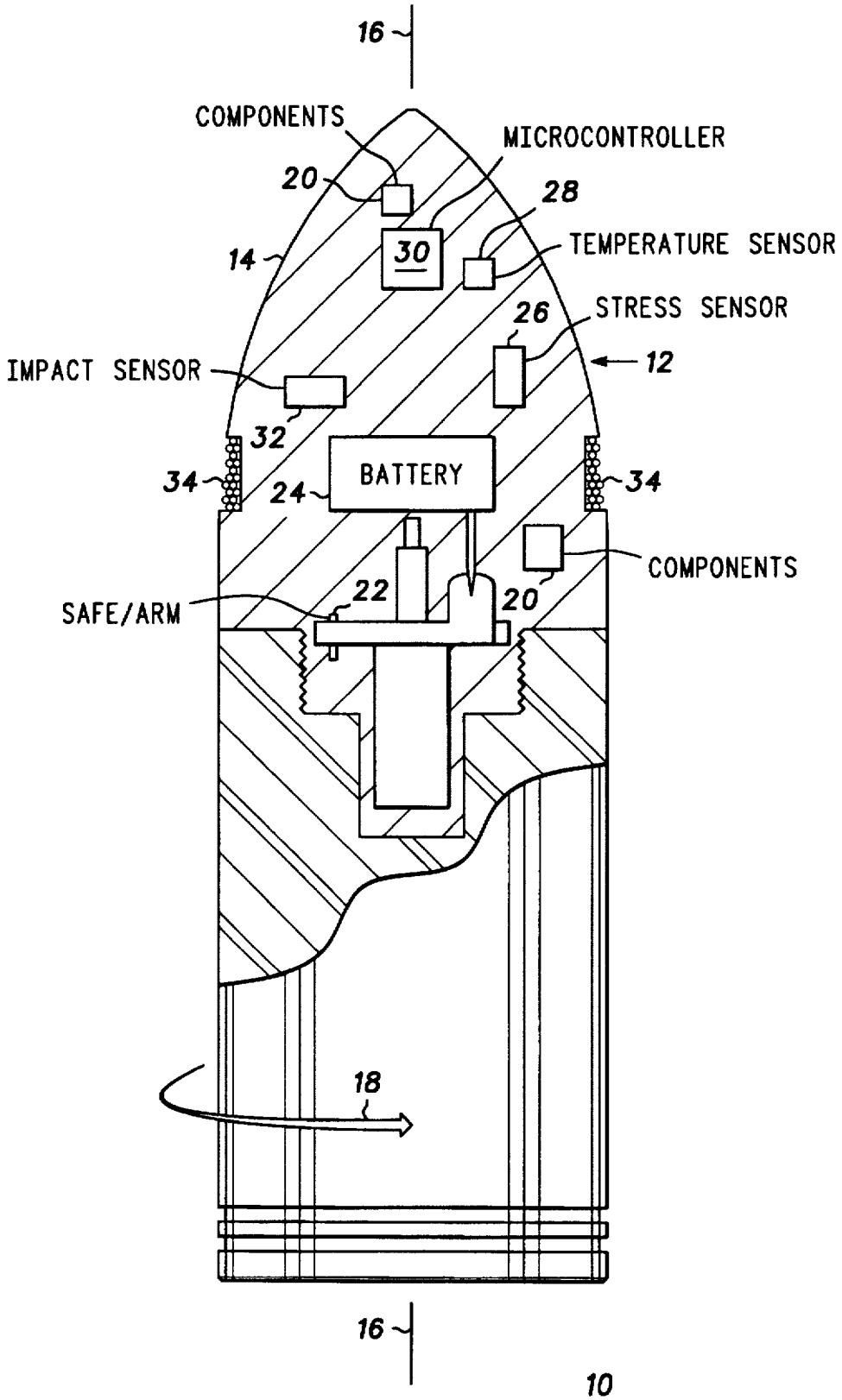
FIG. 1 shows a cross-sectional side view of a projectile which includes an electronic turns-counting fuze.

FIG. 1 shows a cross-sectional side view of a projectile 10 which includes an electronic turns-counting fuze 12. Fuze 12 has a fuze casing 14 which defines the shape and size of the volume of space occupied by fuze 12. Fuze casing 14 desirably has a symmetrical shape around an axis 16.

In general, axis 16 is an imaginary line which is not required to have a structural counterpart within fuze 12 or projectile 10. Axis 16 generally indicates the direction in which projectile 10 travels after launch or firing in order to reach a detonation location. In addition, axis 16 represents the axis about which projectile 10 and fuze 12 turn as they travel, as indicated by a direction arc 18. The turning of projectile 10 is caused by rifling (not shown) in a gun barrel (not shown) from which projectile 10 is launched. This rifling has a characteristic twist factor which causes projectile 10 to experience a certain number of turns for every unit of distance projectile 10 travels regardless of launch velocity.

Fuze 12 includes any number of electrical and other components 20 mounted within casing 14. Components 20 include, for example, an electromechanical safe and arm device 22, a battery 24, an electronic stress sensor 26 preferably implemented using a semiconductor strain gage, a temperature sensor 28, a microcontroller 30, and an impact sensor 32 preferably implemented using a piezoelectric impact crystal. Although not a requirement, electronic components are desirably vertically oriented to best withstand launch. An inductive coil 34 surrounds the bourrelet of projectile 10 to minimize any gap between coil 34 and fuze setter coils (not shown) to best transfer energy. These and other components and circuits are discussed below in connection with FIG. 2.

Stress sensor 26 senses centrifugal forces experienced by sensor 26 as projectile 10 turns. In order to maximize these forces, sensor 26 is desirably mounted within casing 14 at a position substantially parallel to but spaced away from axis 16. In the preferred embodiment of the present invention, sensor 26 may be provided by an MPX pressure sensor die manufactured by Motorola, Inc. Temperature sensor 28 is desirably located near stress sensor 26 to provide a signal with which to compensate for temperature-induced variations in signals produced by stress sensor 26.

Figure 2:
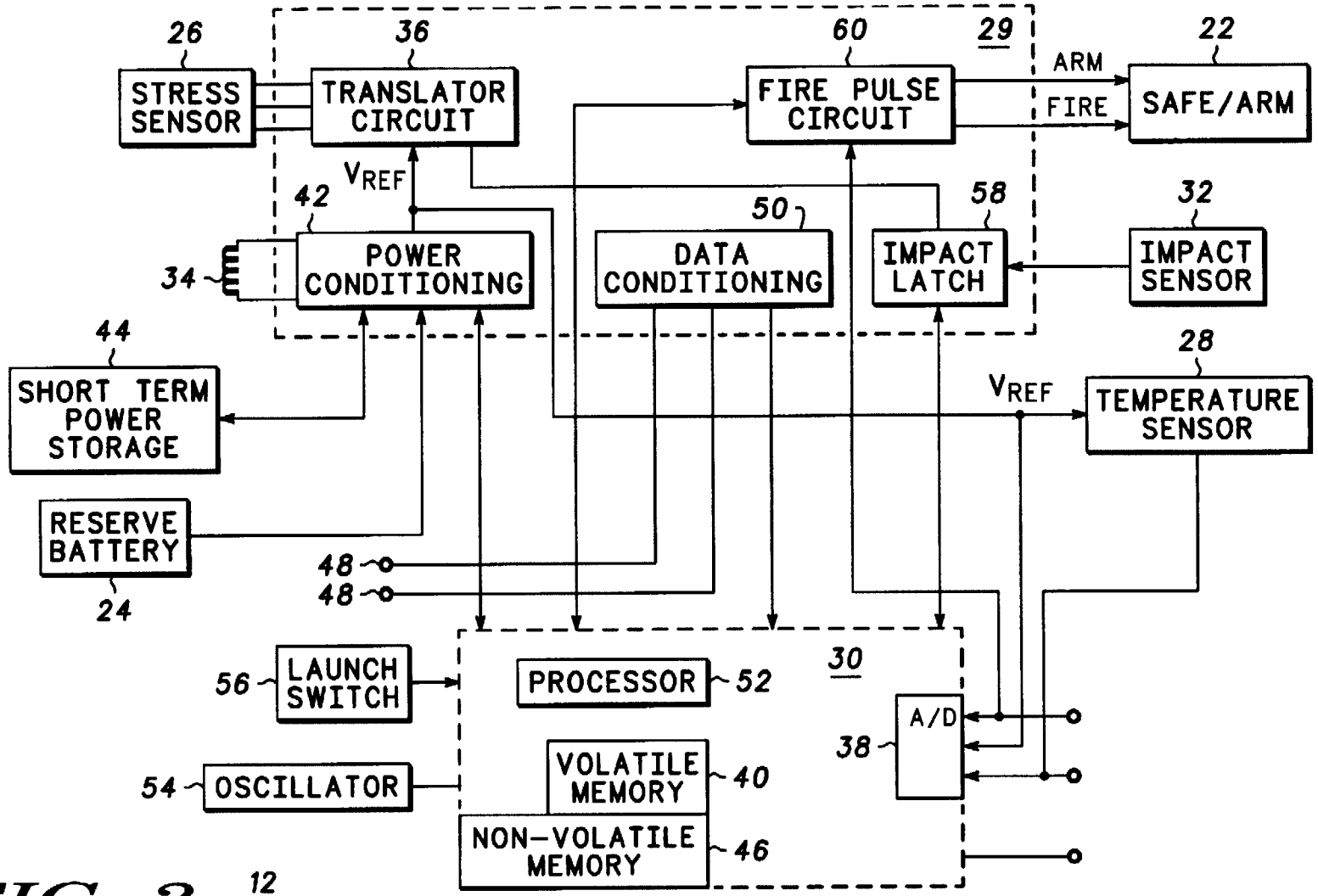
FIG. 2 shows a block diagram of the electronic turns-counting fuze.

FIG. 2 shows a block diagram of electronic turns-counting fuze 12. Stress sensor 26 couples through a translator circuit 36 to an analog-to-digital (A/D) input 38 of an Application Specific Integrated Circuit (ASIC) or microcontroller 30 (hereinafter microcontroller 30). In the preferred embodiment, stress sensor 26 is a transverse voltage strain gage. As fuze 12 spins, centrifugal force acting upon the preferred embodiment of sensor 26 deflects a precision machined silicon diaphragm (not shown) within sensor 26 causing it to change resistance. Translator circuit 36 desirably forms a resistive bridge so that sensor 26 modulates an electrical signal in response to centrifugal forces experienced by sensor 26. A signal which is responsive to centrifugal forces experienced by stress sensor 26 is sensed, digitized, and stored in a volatile memory segment 40 of microcontroller 30.

Inductive coil 34 couples to a power conditioning circuit 42 as does battery 24 and a short term power storage section 44. Power conditioning circuit 42 supplies electrical power to translator circuit 36, temperature sensor 28, microcontroller 30, and other electronic components in fuze 12. Coil 34 is used to transfer energy to fuze 12 from the fuze setter (not shown). When projectile 10 (see FIG. 1) is chambered, battery 24 provides no electrical power output. However, a power signal is induced in coil 34 by the fuze setter. This power signal causes a capacitor in short term power storage section 44 to charge so that sufficient power is available for operating fuze 12 until after projectile 10 is launched. In addition, this power signal is modulated to communicate data to microcontroller 30. The data communicated to microprocessor 30 include, among other things, data defining a final count for the number of turns to detect before activating or otherwise firing fuze 12 and projectile 10.

The distance traversed by projectile 10 to the detonation location may vary slightly depending upon the trajectory followed by the projectile. For example, a relatively straight trajectory will cause projectile 10 to traverse a shorter distance to the detonation location than a trajectory which lobs projectile 10. However, these differences tend to be small from situation to situation. Thus, a fire control computer (not shown) may make reasonable assumptions about the trajectory in computing the final count for the number of turns to count before activating or otherwise firing fuze 12.

In an alternate embodiment of the present invention, microcontroller 30 controls power conditioning circuit 42 so that the fuze setter may likewise detect data being communicated from fuze 12. Power conditioning circuit 42 may, for example, modulate an impedance so that the impedance of inductive coil 34 changes in response to the communicated data. Alternatively, power conditioning circuit 42 may impress an active signal on coil 34. Such data communicated from fuze 12 may include data stored in a non-volatile memory 46 of microcontroller 30. Such data may, for example, describe properties of the projectile with which fuze 12 is associated. The described properties may include projectile weight, average launch speed, propellant characteristics, and the like. Based on these properties and a distance-to-target parameter, a fire control computer (not shown) may more accurately calculate the trajectory to the detonation location, and may more accurately specify the number of turns to count before activating or otherwise firing fuze 12. These properties of projectile 10 may be stored in memory 46 during the manufacturing process through the use of test points 48, which couple to microcontroller 30 through a data conditioning circuit 50.

Stress sensor 26 may be responsive to temperature as well as pressure. Accordingly, temperature sensor 28, which may be implemented using a thermistor, is provided to sense a temperature at which sensor 26 is operating. Since sensors 26 and 28 are located near each other within fuze casing 14 (see FIG. 1), the temperature sensed by sensor 28 should be substantially the same as the temperature experienced by stress sensor 26. The temperature signal is digitized by A/D 38 of microcontroller 30. Personality tables for each of sensors 26 and 28 are stored in non-volatile memory 46 during the manufacturing process. Such data may be entered into fuze 12 through test points 48. Consequently, microcontroller 30 compensates for temperature while translating the results obtained from stress sensor 26.

Desirably, microcontroller 30 determines when projectile 10 and fuze 12 are launched so that it can begin time measuring and turns counting processes, discussed below in connection with FIG. 3. A time base for the time measuring process and a clock for operating a processor portion 52 of microcontroller 30 may be provided by an oscillator 54, which couples to microcontroller 30. Desirably, oscillator 54 is controlled by a crystal to achieve an accurate time base.

In one embodiment of the present invention, a launch switch 56 couples to microcontroller 30. Launch switch 56 activates when experiencing the launch setback acceleration to inform microcontroller 30 that launch has occurred. In an alternative embodiment, microcontroller 30 is configured to monitor stress sensor 26 to identify a launch event. In this embodiment, microcontroller 30 determines when the forces experienced by sensor 26 indicate that a launch has occurred.

Impact sensor 32 and microcontroller 30 couple to an impact latch 58. Impact latch 58 prevents any signals generated by impact sensor 32 from passing beyond impact latch 58 until permitted to do so by a signal provided by microcontroller 30. Those skilled in the art will appreciate that impact sensor 32 may, in some situations, generate a signal upon launch which should not be used to detonate projectile 10. Desirably, microcontroller 30 prevents impact signals from passing through impact latch 58 until after a predetermined time has transpired following launch.

As to firing mechanism, microcontroller 30 and impact latch 58 couple to a fire pulse circuit 60. Upon launch, an ampule associated with battery 24 breaks and an electrolyte begins to spread through battery 24 as projectile 10 spins following launch. Battery 24 begins to generate electricity as the electrolyte spreads within battery 24. Soon after launch, electrical power for fuze 12 is provided by battery 24 and not by short term power storage section 44. Although FIG. 2 omits power connections for clarity, fire pulse circuit 60 includes a capacitor (not shown) which couples to battery 24 and charges as battery 24 generates electricity.

When microcontroller 30 determines that a predetermined duration has transpired since launch, it sends a trigger signal to an SCR (not shown) within fire pulse circuit 60, causing the fire pulse circuit capacitor to discharge an arm pulse into safe and arm device 22. This arm pulse activates a miniature piston actuator in device 22, which forcibly overcomes the centrifugal force bias on a slider (not shown) within device 22 and forces the slider to an armed position. At this point, fire pulse circuit 60 begins to recharge in anticipation of either a point detonating impact or achieving the desired turns count.

A fire signal may be provided to fire pulse circuit 60 by microcontroller 30 when the desired turns count has been reached, as discussed below in connection with FIG. 3. Alternatively, a fire signal may be provided to fire pulse circuit 60 by impact sensor 32 through impact latch 58 when fuze 12 encounters a predetermined level of impact, such as when projectile 10 hits a target. Either fire signal causes fire pulse circuit 60 to trigger an SCR and discharge the fire pulse circuit capacitor to produce a fire pulse. The fire pulse causes safe and arm device 22 to detonate projectile 10 in a conventional manner.

The combination of translator circuit 36, power conditioning circuit 42, data conditioning circuit 50, impact latch 58, and fire pulse circuit 60 in FIG. 2 can be implemented as an ASIC 29, and more particularly as a Complementary Metal Oxide Semiconductor (CMOS) ASIC in a preferred embodiment.

Figure 3:
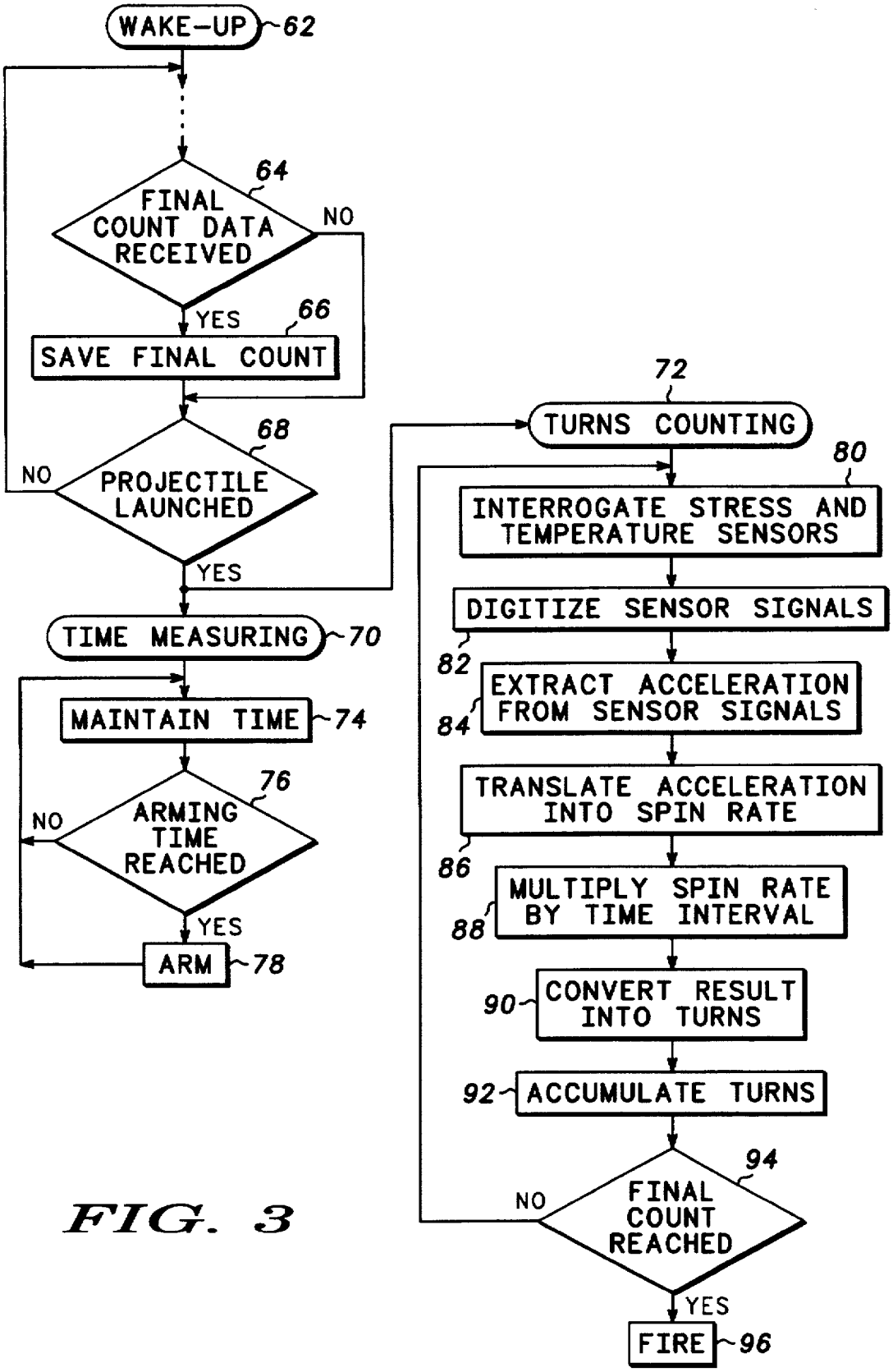
FIG. 3 shows a flow chart of a process performed by the electronic turns-counting fuze.

FIG. 3 shows a flow chart of a process 62 performed by electronic turns-counting fuze 12, and particularly by microcontroller 30. Those skilled in the art will appreciate that process 62 is carried out at least in part by processor 52 in accordance with software programming instructions stored in non-volatile memory 46 (see FIG. 2). Generally, these instructions cause microcontroller 30 to operate as a timer, an integrator, a comparator, and the like.

Process 62 begins when power is first applied to fuze 12. As discussed above, power may be first applied by a signal received through coil 34 (see FIG. 2) from the fuze setter. As indicated by ellipses in FIG. 3, process 62 may perform any number of initializing tasks which are conventional in microcontrolled devices. Such initialization tasks may insure that impact latch 58 (see FIG. 2) prevents impact signals from passing and that SCRs in fire pulse circuit 60 (see FIG. 2) are not in a triggered state. In addition, such tasks may implement a data communication protocol which allows fuze 12 to communicate with devices outside fuze 12, such as the fuze setter. During a data communication session, fuze 12 may transmit data describing properties of projectile 10, and fuze 12 may receive data, such as a final count.

Process 62 eventually performs a query task 64 which determines whether final count data have been received yet from the fuze setter. If the final count data have been received, a task 66 stores the final count in memory 40 (see FIG. 2). After task 66 and when task 64 determines that no final count has been received, program control proceeds to a query task 68. Task 68 determines whether projectile 10 has been fired. Task 68 may monitor launch switch 56 or stress sensor 26 in making its determination. So long as the launch event is not detected, program control loops back toward the beginning of process 62, and task 68 is repeated until launch is detected. Desirably, by the time launch is detected the final count will have been received in a data communication session and stored in memory 40.

When task 68 detects launch, process 62 simultaneously performs both a time measuring process 70 and a turns counting process 72. Time measuring process 70 includes a task 74 which maintains a current time. Desirably, task 74 is configured to accumulate time since launch. After task 74, a query task 76 determines whether the arming duration has transpired. Task 76 may compare the current elapsed time maintained by task 74 with a predetermined duration, for example 450 msec. So long as the arming duration has not yet transpired, program control loops back to task 74 to continue maintaining time. When task 76 eventually detects the arming duration, a task 78 is performed to arm fuze 12. Task 78 may cause fire pulse circuit 60 (see FIG. 2) to generate its arm pulse and may enable impact latch 58 to let impact sensor signals pass. After task 78, program-control may loop back to task 74 as shown in FIG. 3 or exit process 70 (not shown).

Turns counting process 72 takes place simultaneously with time measuring process 70. Thus, process 72 is initiated as soon as launch is detected. Process 72 includes a task 80 which interrogates stress and temperature sensors 26 and 28. Next, a task 82 digitizes the signals from these sensors, and a task 84 extracts centripetal acceleration from the sensor signals. Task 84 may, for example, perform table look-up operations based upon current data obtained from sensors 26 and 28 and personality data programmed into non-volatile memory 46 (see FIG. 2) to identify a number which is substantially independent of temperature influences and which corresponds to centripetal acceleration. Of course, those skilled in the art will appreciate that centripetal acceleration also corresponds to the centrifugal force currently being experienced by sensor 26.

Next, a task 86 translates the centripetal acceleration into a spin rate. The rate of spin is proportional to the square root of the centrifugal force (or to the square root of the acceleration divided by the spin radius). Thus, task 86 may include the taking of a square root. After task 86, a task 88 multiplies the spin rate by a time interval, and a task 90 applies any needed scale factors to convert the result into a number which describes the number of turns or fraction of a turn experienced by sensor 26 and fuze 12 since the previous calculation. The time interval used in task 88 desirably equals the amount of time which transpires between iterations of task 80. After task 90, a task 92 accumulates turns by adding the turns or fraction of a turn computed above in task 90 to an accumulation total. After task 92, a query task 94 compares this accumulation total with the final count to determine whether the final count has been reached. If the final count has not yet been reached; program control loops back to task 80 to again interrogate sensor 26 and further accumulate the number of turns experienced by fuze 12.

Those skilled in the art will appreciate that many of tasks 84, 86, 88, 90, and 92 may be combined. For example, table look-up operations may be devised to combine various ones of tasks 84, 86, 88, and 90. Generally, such tasks translate the stress signal generated by stress sensor 26 into data describing the number of turns experienced by fuze 12 since a prior calculation. Ongoing iterations of task 92 cause microcontroller 30 to operate as an integrator which integrates the stress sensor signal to determine the total number of turns experienced by fuze 12 since launch. Likewise, ongoing iterations of task 94 cause microcontroller 30 to operate as a comparator which determines when the number of turns experienced by fuze 12 reaches the preset final count.

When task 94 signals that the number of turns experienced by fuze 12 has reached the final count, a task 96 is performed to cause fire pulse circuit 60 to generate the fire pulse and detonate projectile 10. In order for projectile 10 to detonate, the arming duration must have first transpired, as determined through the operation of process 70. Moreover, impact sensor 32 (see FIG. 2) may, at any time following the arming duration, sense an impact which leads to the detonation projectile 10.

In summary, the present invention provides an improved turns-counting fuze. The turns-counting fuze of the present invention relies upon inexpensive, miniaturized, and reliable electronic components to count turns. Consequently, the turns-counting fuze precisely detects and counts turns at a low cost and in a reliable manner. An electronic stress sensor detects centrifugal forces imposed on the sensor by a spinning projectile. These forces are translated into an encountered number of turns.

The present invention also has the ability to memorize projectile "personality characteristics" and provides burst at a predictable distance, essentially independent of launch velocity. The device and method are suitable for use in devices small enough for a rifle grenade.

The present invention has been described above with reference to preferred embodiments. However, those skilled in the art will recognize that changes and modifications may be made in these preferred embodiments without departing from the scope of the present invention. For example, those skilled in the art will appreciate that the sequence and classification of tasks described above may be varied while accomplishing substantially the same processes. Likewise, those skilled in the art will appreciate that fewer or additional safeguards against unwanted detonation and events which cause detonation may be incorporated into the fuze. These and other changes and modifications which are obvious to those skilled in the art are intended to be included within the scope of the present invention.

What is claimed is:

1. An electronic turns-counting fuze comprising:

a fuze casing;

an electronic stress sensor mounted within said fuze casing, said sensor configured to modulate an electrical signal in response to centrifugal forces experienced by said sensor; and an integrator, coupled to said electronic stress sensor, said integrator for integrating said electrical signal to determine a number of turns experienced by said electronic turns-counting fuze.

2. An electronic turns-counting fuze as claimed in claim 1 wherein:

said fuze casing has an axis about which said electronic turns-counting fuze spins enroute to a target; and said electronic stress sensor is mounted within said fuze casing at a position spaced away from said axis.

3. An electronic turns-counting fuze as claimed in claim 1 additionally comprising:

a memory for storing data describing a final count;

a comparator, coupled to said memory and said integrator, for determining when said number of turns reaches said final count; and firing means, coupled to said comparator for activating said electronic turns-counting fuze when said number of turns reaches said final count.

4. An electronic turns-counting fuze as claimed in claim 3 wherein said integrator and said comparator are provided by a microprocessor mounted within said fuze casing.

5. An electronic turns-counting fuze as claimed in claim 3 additionally comprising a data communication port, coupled to said memory, for receiving said data describing said final count.

6. An electronic turns-counting fuze as claimed in claim 1 additionally comprising:

a timer adapted to hold said electronic turns-counting fuze in a safe condition for a predetermined duration and then arm said electronic turns-counting fuze for subsequent activation; and firing means, coupled to said integrator and said timer, for activating said electronic turns-counting fuze when said number of turns reaches a final count.

7. An electronic turns-counting fuze as claimed in claim 1 additionally comprising:

an impact detection sensor adapted to signal when said electronic turns-counting fuze encounters a predetermined level of impact; and firing means, coupled to said integrator and said impact detection sensor, for activating said electronic turns-counting fuze when said predetermined level of impact is detected or when said number of turns reaches a final count.

8. An electronic turns-counting fuze as claimed in claim 1 wherein:

said electrical signal is influenced by temperature; and said electronic turns-counting fuze additionally comprises a temperature sensor mounted within said fuze casing, said temperature sensor being coupled to at least one of said stress sensor and said integrator to compensate for said influence of temperature.

9. A method of activating a fuze having a fuze casing comprising the steps of:

providing a semiconductor stress sensor within said fuze casing, said sensor being configured to modulate an electrical signal in response to centrifugal forces experienced by said sensor; and translating said electrical signal into data describing a number of turns experienced by said fuze.

10. A method as claimed in claim 9 wherein:

said fuze casing has an axis about which said fuze spins enroute to a target; and said providing step mounts said sensor within said fuze casing at a position spaced away from said axis.

11. A method as claimed in claim 9 additionally comprising the steps of:

storing data describing a final count;

determining when said number of turns reaches said final count; and activating said fuze when said number of turns reaches said final count.

12. A method as claimed in claim 11 additionally comprising the steps of:

receiving said data describing said final count from outside said fuze;

firing a projectile which includes said fuze, said firing step occurring after said receiving step; and performing said translating step after said firing step.

13. A method as claimed in claim 9 additionally comprising the steps of:

determining when a projectile which incorporates said fuze is fired;

holding said fuze in a safe condition for a predetermined period of time following firing of said projectile; and activating said fuze after expiration of said predetermined period when said number of turns reaches a final count.

14. A method as claimed in claim 9 additionally comprising the steps of:

providing a signal which indicates whether said fuze has encountered a predetermined level of impact; and activating said fuze when said predetermined level of impact is indicated or when said number of turns reaches a final count.

15. A method as claimed in claim 9 wherein:

said electrical signal is responsive to centrifugal force and to temperature; and said translating step comprises the step of sensing temperature within said fuze casing so that said data describing said number of turns are responsive to said centrifugal force experienced by said fuze and to temperature.

16. An electronic turns-counting fuze comprising:

a fuze casing having an axis about which said fuze spins enroute to a target;

a semiconductor strain gage mounted within said fuze casing at a position spaced away from said axis, said gage being configured to modulate an electrical signal in response to centrifugal forces experienced by said gage;

an integrator, coupled to said gage, for integrating said electrical signal to determine a number of turns experienced by said fuze;

a memory for storing data describing a final count;

a comparator, coupled to said memory and said integrator, for determining when said number of turns reaches said final count; and firing mechanism, coupled to said comparator for activating said fuze when said number of turns reaches said final count.

17. A fuze as claimed in claim 16 additionally comprising a data communication port, coupled to said data memory, for receiving said data describing said final count.

18. A fuze as claimed in claim 16 wherein:

said fuze additionally comprises a timer coupled to said firing mechanism, said timer being configured to indicate a duration which transpires after firing a projectile which includes said fuze; and said firing mechanism is configured to prevent activation of said fuze until a predetermined duration has transpired.

19. A fuze as claimed in claim 16 wherein:

said fuze additionally comprises an impact detection sensor coupled to said firing mechanism, said impact detection sensor being adapted to signal when said fuze encounters a predetermined level of impact; and said firing mechanism is configured to activate said fuze when said predetermined level of impact is detected or when said number of turns reaches said final count.

20. A fuze as claimed in claim 16 wherein:

said electrical signal is influenced by temperature; and said fuze additionally comprises a temperature sensor mounted within said fuze casing, said temperature sensor being coupled to at least one of said strain gage and said integrator to compensate for said influence of temperature.

* * * * *